US010694793B2

(12) United States Patent
West et al.

(10) Patent No.: US 10,694,793 B2
(45) Date of Patent: Jun. 30, 2020

(54) NON-CHEMICAL, MOSQUITO BITE-RESISTANT GARMENTS

(71) Applicant: North Carolina State University, Raleigh, NC (US)

(72) Inventors: Andre J. West, Raleigh, NC (US); Marian G. McCord, Raleigh, NC (US); Charles S. Apperson, Raleigh, NC (US); Richard Michael Roe, Raleigh, NC (US); Emiel A. DenHartog, Raleigh, NC (US)

(73) Assignee: NORTH CAROLINA STATE UNIVERSITY, Raleigh, NC (US)

( * ) Notice: Subject to any disclaimer, the term of this patent is extended or adjusted under 35 U.S.C. 154(b) by 0 days.

(21) Appl. No.: 16/039,628

(22) Filed: Jul. 19, 2018

(65) Prior Publication Data

US 2019/0021409 A1 Jan. 24, 2019

Related U.S. Application Data

(60) Provisional application No. 62/534,663, filed on Jul. 19, 2017.

(51) Int. Cl.

| | |
|---|---|
| ***A41D 13/00*** | (2006.01) |
| ***A41B 9/14*** | (2006.01) |
| ***A41B 7/00*** | (2006.01) |
| ***D04B 1/24*** | (2006.01) |
| ***A41B 9/12*** | (2006.01) |
| ***A41B 17/00*** | (2006.01) |
| ***A41B 9/08*** | (2006.01) |
| ***D04B 21/20*** | (2006.01) |
| ***D04B 1/16*** | (2006.01) |

(52) U.S. Cl.

CPC ..... *A41D 13/001* (2013.01); *A41B 7/00* (2013.01); *A41B 9/08* (2013.01); *A41B 9/12* (2013.01); *A41B 9/14* (2013.01); *A41B 17/00* (2013.01); *D04B 1/16* (2013.01); *D04B 1/24* (2013.01); *D04B 1/246* (2013.01); *D04B 21/207* (2013.01); *A41B 2300/32* (2013.01); *A41B 2500/10* (2013.01); *A41D 2300/32* (2013.01); *A41D 2500/10* (2013.01); *D10B 2331/02* (2013.01); *D10B 2331/06* (2013.01); *D10B 2331/12* (2013.01); *D10B 2501/02* (2013.01)

(58) Field of Classification Search

CPC ..... A41D 13/001; A41B 17/00; A41B 9/08; A41B 9/12

USPC ..... 2/456, 4, 69, 79

See application file for complete search history.

(56) References Cited

U.S. PATENT DOCUMENTS 1,833,163 A * 11/1931 Ischinger ..... A41B 11/06 2/239

3,488,776 A * 1/1970 Luhr ..... A41D 1/22 2/109

3,496,572 A * 2/1970 Herzig ..... A41D 13/02 2/457

(Continued)

*Primary Examiner* — Gloria M Hale

(74) *Attorney, Agent, or Firm* — Thomas|Horstemeyer, LLP

(57) ABSTRACT

An insect-proof, form-fitting undergarment is provided having top and bottom parts formed of selected breathable materials and having omnidirectional stretch properties, and which top and bottom parts may be securely joined at the waist to prevent insect entry. A superfine knitted fabric is utilized to prevent insect bites.

19 Claims, 9 Drawing Sheets

(56) References Cited

U.S. PATENT DOCUMENTS

| | | | | | |
|---|---|---|---|---|---|
| 3,994,026 | A * | 11/1976 | Sampey | A41D 13/02 | 2/79 |
| 4,395,781 | A * | 8/1983 | Myers | A41D 13/001 | 2/4 |
| 4,422,184 | A * | 12/1983 | Myers | A41D 13/001 | 2/4 |
| 4,601,066 | A * | 7/1986 | Campbell | A41D 1/04 | 2/70 |
| 4,685,152 | A * | 8/1987 | Heare | A01K 55/00 | 2/227 |
| 4,985,933 | A * | 1/1991 | Lemoine | A41D 13/001 | 2/4 |
| 5,343,564 | A * | 9/1994 | Reynolds | A41D 13/001 | 2/236 |
| 5,717,990 | A * | 2/1998 | Alquist | A01K 55/00 | 2/202 |
| 5,794,263 | A * | 8/1998 | Carman | A41D 13/001 | 2/202 |
| 2002/0124293 | A1* | 9/2002 | Zeiler | A01K 55/00 | 2/4 |
| 2005/0278837 | A1* | 12/2005 | Wallerstein | A41D 13/001 | 2/456 |
| 2006/0048258 | A1* | 3/2006 | Seo | A41D 13/001 | 2/4 |
| 2012/0005812 | A1* | 1/2012 | Corzatt | A41D 13/001 | 2/456 |
| 2013/0232676 | A1* | 9/2013 | Corzatt | A41D 13/001 | 2/456 |
| 2017/0347722 | A1* | 12/2017 | Johnson | A41D 13/001 | |

* cited by examiner

NON-CHEMICAL, MOSQUITO BITE-RESISTANT GARMENTS

CROSS-REFERENCE TO RELATED APPLICATIONS

This application claims the benefit of and priority to U.S. Provisional Application Ser. No. 62/534,663, having the title "NON-CHEMICAL, MOSQUITO BITE-RESISTANT GARMENTS", filed on Jul. 19, 2017, the disclosure of which is incorporated herein by reference in its entirety.

TECHNICAL FIELD

The present disclosure generally relates to garments, and in particular to undergarments that are mosquito bite-resistant.

BACKGROUND

A great number of protective garment teachings or particular combinations of protective features which have been developed over a long period of years. One example is U.S. Pat. No. 4,685,152 which teaches a heavy, tightly sealed outer garment intended for insect protection, and this type of protective garment also includes absolute protection about the head and face as it includes an isolating visor and head closure member. This device is an outer garment wherein tightness of closure is a prime feature. U.S. Pat. No. 3,496,572 provides teaching of another form of outer garment that provides tight closure in protection of the human body. In this case, the suit is intended for dust-proof maintenance of the wearer. This patent too is directed to a very bulky outer garment with a plurality of straps and cinches about selected body areas and including a visor and full head protector. Wrist and ankle security is further protected by multiple wraps of isolation material.

U.S. Pat. No. 4,601,066 teaches a more form-fitting type of outer garment of the type that is intended for use by dancers, gymnasts and acrobats. Here again, the wrists and ankles are wrapped with multiple folds in order to provide warming at the extremities and neck of the wearer.

Prior-art protective undergarments do not prevent mosquito bites. There remains a need for improved undergarments that overcome these deficiencies.

BRIEF DESCRIPTION OF THE DRAWINGS

Further aspects of the present disclosure will be readily appreciated upon review of the detailed description of its various embodiments, described below, when taken in conjunction with the accompanying drawings.

(FIG. 6A) body of the device showing the blood reservoir and stainless steel heating coils, (FIG. 6B) collagen film, (FIG. 6C) cork gasket, (FIG. 6D) plastic frame, (FIGS. 6E-6G) valves and stem, (FIG. 6H) clips, and (FIG. 6I) PVC collar and clamp for holding the device.

DETAILED DESCRIPTION

Figure 1A:
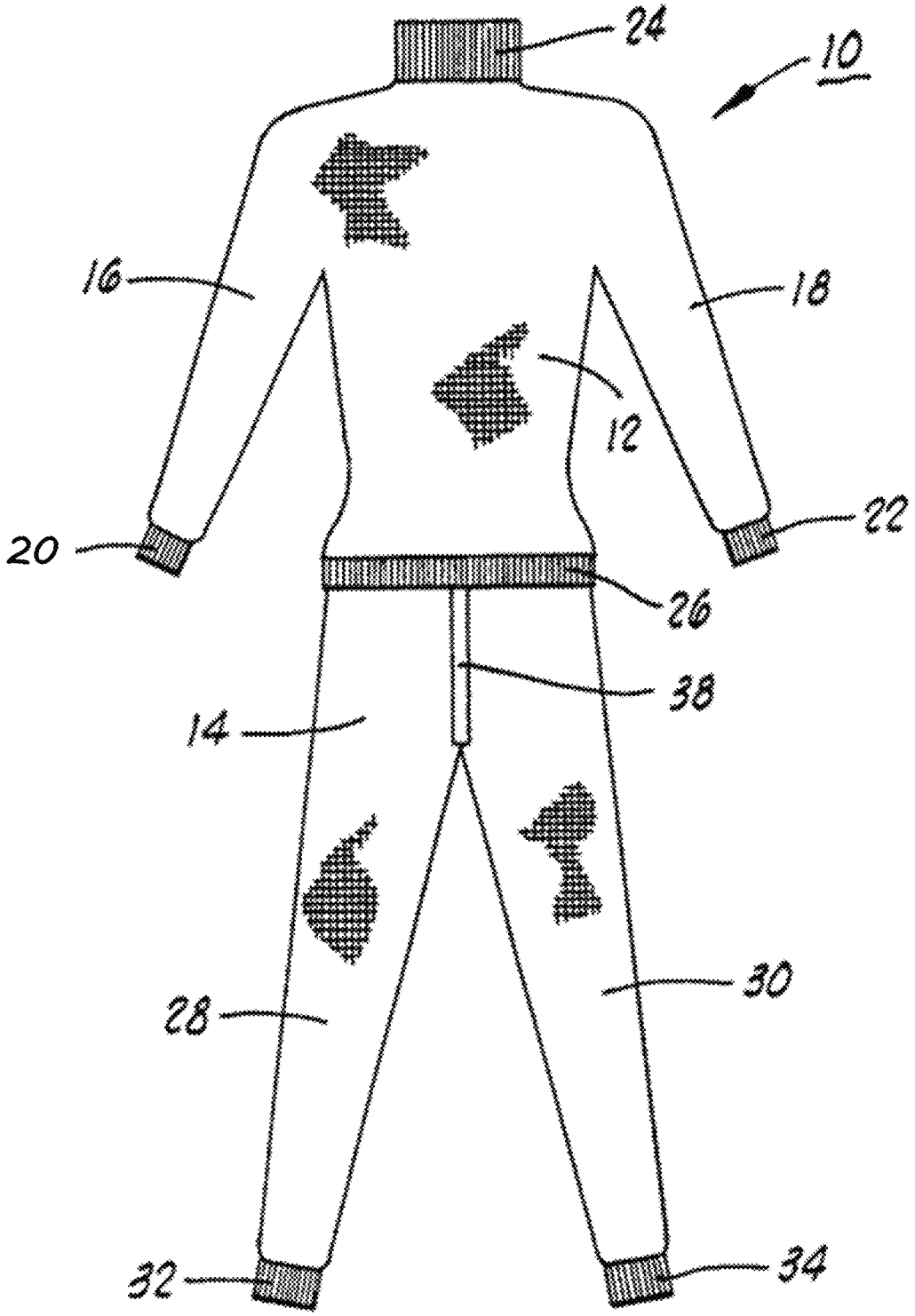
FIGS. 1A-B are views of exemplary undergarments.

In various aspects, form-fitting insect-proof protective undergarments are provided. The undergarments can include a synthetic knit material made with ultrafine fibers and providing mosquito bite resistance. For example, the synthetic knit materials can provide a mosquito bite resistance of about 99% or more or about 100% when measured according to the in vivo feeding bioassay described herein.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting. The skilled artisan will recognize many variants and adaptations of the embodiments described herein. These variants and adaptations are intended to be included in the teachings of this disclosure and to be encompassed by the claims herein.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant specification should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

Although any methods and materials similar or equivalent to those described herein can also be used in the practice or testing of the present disclosure, the preferred methods and materials are now described. Functions or constructions well-known in the art may not be described in detail for brevity and/or clarity. Embodiments of the present disclosure will employ, unless otherwise indicated, techniques of material science, textiles engineering and the like, which are within the skill of the art. Such techniques are explained fully in the literature.

It should be noted that ratios, concentrations, amounts, and other numerical data can be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to about 5%" should be interpreted to include not only the explicitly recited values of about 0.1% to about 5%, but also include individual values (e.g., 1%, 2%, 3%, and 4%) and the sub-ranges (e.g., 0.5%, 1.1%, 2.2%, 3.3%, and 4.4%) within the indicated range. Where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In some embodiments, the term "about" can include traditional rounding according to significant figures of the numerical value. In addition, the phrase "about 'x' to 'y'", where 'x' and 'y' are numerical values, includes "about 'x' to about 'y'".

Definitions

Unless defined otherwise, all technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

The articles "a" and "an," as used herein, mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

The term "form-fitting," as used herein, refers to materials and garments which are compliant and which will readily conform to the general shape and contours of the wearer's body.

The term "undergarment," as used herein, refers to a garment designed to be worn next to the body or a portion thereof and regardless of whether additional garments are worn on top thereof.

Undergarments

A variety of undergarments are provided. The undergarments can include one or both of an upper body form-fitting garment and a lower body form-fitting garment. The garments can be insect proof and/or protective. The garments can provide for mosquito bite resistance, especially when worn together.

The undergarment can include an upper body, form-fitting garment (also described as an upper body portion). The upper body form-fitting garment can have a torso section having an elastic neck cuff secured to define a neck opening of the torso section and an elastic waist cuff secured to define a waist band around the torso section. The neck can include a collar such as, e.g. a high, turtle-type knit collar, or crew neck. The upper body form-fitting garment can have a left arm section and a right arm section, each of the arm sections having an inner terminus attached to the torso section and an outer terminus having an elastic wrist cuff. The arm sections can be tubularly seamed in conventional manner and joined to a top part of the torso section by opposite diagonal shoulder seams.

The undergarment can include a lower body, form-fitting garment (also described as a lower body portion). The lower body, form-fitting garment can include a waist section having an elastic waist cuff secured to define a waist band around the waist section. The lower body, form-fitting garment can include a left leg section and a right leg section, each of the leg sections having an inner terminus attached to the waist section and an outer terminus having an elastic ankle cuff. The lower body, form-fitting garment can include a fly flap disposed vertically in the waist section with a fastener means aligned therealong to effect closure. The lower body, form-fitting garment can include a fastener means for securing the elastic waist cuff of the upper body, form-fitting garment and the elastic waist cuff of lower body, form-fitting garment to secure the torso section waist band to the waist section waist band.

The upper body, form-fitting garment and the lower body, form-fitting garment can be configured to be joined and/or to overlap when being worn so as to provide a continuous protection from insects and mosquito bites. For example, the upper body form-fitting garment can have a shirt tail extending from the upper garment torso section in extension below the elastic waist cuff so that the elastic waist cuffs of the upper and lower body portions interlock over the shirt tail.

In various embodiments, the upper body, form-fitting garment and the lower body, form-fitting garments can be configured to be joined by a fastener means e.g. hook and loop, zippers, snaps, buttons, ties, drawstrings, or other clothing fasteners known in the art. For example, the undergarments can include a hook and loop fastener for securing, for example by having a first strip of hook fastener secured around the outer surface of the waist band around the torso section and a second strip of loop fastener secured around the outer surface of the waist band around the waist section, whereby the first and second strips are configured to be joined together.

The upper body, form-fitting garment and the lower body, form-fitting garment can be integrated as a single garment so as to provide a continuous protection from insects and mosquito bites. For example, the upper body, form-fitting garment and the lower body, form-fitting garment can be part of a continuous garment (e.g. a union suit). The single form-fitting garment can include a fly flap and/or a rear flap. The single form-fitting garment can also include a vertical closure for ease of donning and removing. Each of the flaps and closures can be secured by fastener means such as hook and loop configurations, zippers, snaps, buttons, ties, drawstrings, or other clothing fasteners and combinations thereof known in the art.

The upper body, form-fitting garment and the lower body, form-fitting garment include a variety of elastic cuffs. The cuffs can provide enhanced insect protection and prevent entry of insects there through when in use by the wearer. Each of the cuffs can be suitably formed as by knitting to include sufficient elasticity to assure firm fitting without any discomfort. The undergarment or portions thereof can further include a liner material, although not necessary, to ensure bite protection, and that can provide improved comfort in some aspects. For example, a cotton liner material can be provided in one or more sections of the undergarment. The undergarment can further include reinforcing materials in the joint areas. For example, the undergarment can include reinforcing material added by stitching to the elbows of the upper garment part arm sections and/or the lower garment part leg sections.

One or both, preferably both, of the upper body, form-fitting garment and the lower body, form-fitting garment can be made entirely or partially from a synthetic knit material designed to provide enhanced mosquito bite resistance. The synthetic knit material can include about 70% to 90%, about 75% to 80%, or about 80% by weight of a polyamide fiber based upon a total weight of the synthetic knit material. The polyamide fiber can have a fiber thickness of about 15 to 25, about 18 to 22, or about 20 denier count. The synthetic knit material can include about 10% to 30%, about 15% to 25%, or about 20% of an elastane fiber based upon the total weight of the synthetic knit material. The elastane fiber can have a fiber thickness of about 10 to 20, about 12 to 18, or about 15 denier count.

The synthetic knit material can be lightweight and/or stretchable. For example, the synthetic knit material can have a weight of about 2.5 to 3.0, about 2.6 to 2.9, or about 2.8 ounces per square yard. The synthetic knit material can have a stretch in a width of the synthetic knit material of about 200% to 260%, about 220% to 260%, about 230% to 250%, or about 240%. The synthetic knit material can have a stretch in a length of the synthetic knit material of about 130% to 190%, about 140% to 190%, about 140% to 180%, or about 160%. The synthetic knit material can have a jersey plated knit structure having about 80-90, about 82-86, or about 84 wales and about 110-120, about 110-114, or about 112 courses per inch, and an average pore size of about 20 μm to 40 μm, about 25 μm to 30 μm, or about 27 μm to 34 μm.

The synthetic knit materials and undergarments made therefrom can provide an enhanced level of mosquito bite resistance. The mosquito bite resistance of the synthetic knit materials and undergarments made therefrom can be tested using in vivo and arm-in-cage test methods described herein or variations thereof. The bite resistance can be reported as a percentage bite resistance as described herein. In some aspects, the synthetic knit materials provide a mosquito bite resistance of about 95%, about 98%, about 99%, about 99.5%, or more when measured according to the in vivo feeding bioassay described herein. In some aspects, the synthetic knit materials provide a mosquito bite resistance of about 100% when measured according to the in vivo feeding bioassay described herein. The synthetic knit materials and undergarments made therefrom can provide a mosquito bite resistance of about 95%, about 98%, about 99%, about 99.5%, or more when measured according to the arm-in-cage test described herein. In some aspects, the synthetic knit materials and undergarments made therefrom provide a mosquito bite resistance of about 100% when measured according to the arm-in-cage test described herein.

In Vivo Feeding Bioassay

The synthetic knit materials can be tested in an in vitro blood-feeding device (FIGS. 6A-6I and 7A-7B). The in vitro blood-feeding device (FIGS. 6A-6I and 7A-7B) was constructed from Plexiglas®. Briefly, a reservoir for blood (16.5 cm length×3.5 cm width×0.5 cm depth) was produced by a hand-held router in a rectangular piece of Plexiglas (28 cm length×5.5 cm width×1 cm thickness). A hole (4 mm dia.) was drilled at the center of the top and bottom edge through the plastic into the blood reservoir. A tap was used to cut threads into the plastic so that a valve could be screwed into the top and bottom holes. Two holes (each 4 mm dia.) were drilled from the bottom edge of the device through the plastic to the blood reservoir. A loop of stainless steel tubing (3 mm dia.) was placed into the blood reservoir, and the tubing was inserted through the holes so that the cut ends protruded out of the plastic. Epoxy cement was used to seal the tubing in place inside the blood reservoir of the device. The ends of the tubing were connected to a circulating water bath to heat the blood.

To setup for a blood feeding bioassay, a transparent collagen film (product code 894010.95; Devro, Inc., Columbia, S.C. USA) was hydrated in distilled water and stretched over the top of the device. A gasket, cut from a sheet of cork-rubber composite (Fel-Pro, part no. 3019; AutoZone, Raleigh, N.C. USA) was placed on top of the collagen film. A rectangular piece of plastic (3 mm thick) the size of the blood-feeding device was then placed on top of the gasket. The central area of both the rubber gasket and plastic frame was removed so that the collagen film is fully exposed. Metal binder clips hold the gasket and frame in place on top of the blood-feeding device, preventing leakage of blood. A 30 mL syringe filled with blood was then attached to the valve that was screwed into the top hole of the blood-feeding device. With the device tilted at a slight downward angle the blood was slowly transferred into the reservoir. The valve attached to the bottom of the device opened to allow air displaced by the blood to escape. When the device was filled, both valves were closed, and the circulating water bath was turned on to warm the blood to 35° C.

The synthetic knit materials to be evaluated for bite resistance are cut to exactly fit over the collagen film within the plastic frame. Masking tape, placed around the inner edges of the plastic frame, slightly overlaps the cloth. In this way, mosquitoes are prevented from gaining access to the collagen film by probing around the edges of the cloth. The blood-feeding device was inserted into a Plexiglas bioassay cage (30×30 cm on each side) containing mosquitoes.

Prior to inserting the blood-feeding device, 25 female mosquitoes were transferred to the bioassay cage. Aedes aegypti females were starved overnight (sugar water removed from their rearing cage; females not blood fed) prior to testing, while Anopheles gambiae females were starved for only 4 h before each bioassay. Female mosquitoes from 4-10 days of age (post emergence) were used for bioassays. Porcine blood obtained from a local abattoir was used in our bioassays. At the time of collection, sodium citrate was added as an anticoagulant. Just prior to initiating the bioassay, ATP (Sigma) was added to the blood (2.5 mg/mL blood) as a phagostimulant (Benzon and Apperson 1987). Each bioassay was conducted for 10 min., during which the number of times females land and probe the cloth was counted. A single event was recorded if a female landed and then inserted or attempted to insert her proboscis into the cloth, regardless of whether the female probed multiple times after landing. A video recording was made of each bioassay so that the mosquitoes' responses to the surface of each cloth and probing behavior could be studied. At the end of the exposure period, mosquitoes were removed and killed in a freezer. Subsequently, each mosquito was crushed on a sheet of white paper to determine if she was able probe through the cloth and obtain a blood meal. In vitro bioassays were repeated for each candidate fabric a minimum of 3 times with each mosquito species and the appropriate controls (no cloth, a control cloth excised from a military garment with no bite protection, and a control cloth excised from a military garment with bite protection). Calculations for percentage bite resistance and statistical analyses are described later.

Arm-In-Cage Studies

The synthetic knit materials and undergarments made therefrom can also be tested in arm-in-cage studies and compared to controls. In vivo assays were carried out with informed consent using a protocol for use of human subjects in research that has been approved by the NC State University Institutional Review Board (IRB #2925). A sleeve device was constructed to bioassay textiles that were found to be bite resistant in in vitro assays. The sleeve was constructed from a polyvinyl coated roofing membrane, Sarnafil® (Sika Corp., Canton, Mass. USA). The sleeve was cut into a trapezoidal shape with a 16.5 cm×3.5 cm opening in the center that corresponds to the size and shape of the opening in the in vitro blood-feeding device. A plastic frame was riveted to the sleeve to keep the exposure area from deforming when the sleeve was attached to the forearm of the study participant.

Female mosquitoes are transferred to a bioassay cage 10-30 minutes before bioassays are started. A candidate cloth was laid on the underside of a forearm of a study participant. The sleeve was laid on top of the cloth and attached to the participant's forearm with Velcro® straps. The hand of the participant was then covered with a nitrile glove. The bioassay was started when the participant inserted his/her arm through the sleeve into the bioassay cage. An observer counted the numbers of mosquitoes landing on the cloth and probing during a 10 min. exposure period. After the bioassay was terminated, mosquitoes were examined for blood feeding as previously described. The mosquito conditioning, the numbers of mosquitoes used and level of replication were the same as that described for the in vitro assay.

Data Analysis

Percentage bite resistance for each test cloth were calculated as follows: (control count-treatment count/control count)×100 for each of the controls, i.e., the bare skin and skin covered by bite permissive cloth. The results were be compared to that for an example of a military textile in use designed for bit protection, i.e., permethrin treated uniform material. Percentage bite resistance data were transformed as needed to achieve approximate normality and then analyzed using a repeated measures ANOVA, with unstructured error covariance. To determine whether statistically significant differences in mean percentage bite resistance ($P=0.05$) exist between the treatment and controls across all time points and at each time point, probability of difference values were calculated in LSD tests for LSM bit resistance under the hypothesis Ho: LSM(i)=LSM(j) (SAS Institute 2003).

The textile can be effective via a physical barrier that can prevent insect bites or a non-toxic treatment that can render the insect harmless without contaminating the environment or posing a potential health risk. These textile materials can mitigate the incidence of insecticide resistance in the vector population and provide an effective alternative to current chemically treated materials. In addition to clothing, there are a number of other cloth items that can benefit from advanced non-chemical insect-resistant treatments, such as mosquito netting, camouflage helmet covers, ground covers, and tentage.

EXAMPLES

In general, the following Examples describe some additional embodiments of the present disclosure. While embodiments of the present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure.

Referring to FIG. 1A, an undergarment 10 includes an upper (shirt) part 12 and a bottom (pants) part 14, each of which can be formed from a selected synthetic plastics material that has desirable attributes as to weight, stretch and closeness of weave. The shirt part 12 includes right and left arms 16 and 18 which can terminate in respective knit cuffs 20 and 22. The shirt part 12 can also include a knit collar 24, which can be a high, turtle-type, and/or a waist cuff 26. Each of the cuffs can be suitably formed as by knitting to include sufficient elasticity to assure firm fitting without any discomfort. The arms 16 and 18 can be tubularly seamed in a conventional manner and joined to shirt part 12 by opposite diagonal shoulder seams.

It is desirable that the material of shirt part 12 be a selected material woven from low denier yarn which exhibits qualities of very lightweight and omnidirectional stretch so that a good, comfortable form-fit is achieved. Generally speaking, any of a number of nylon stretch materials may be used; however, practice has shown that a material known as Glistenette available from Minnetonka Mills, Inc. of Minneapolis, Minn., is quite good for the present use. This material consists of 90 percent ANTRON™ nylon and 10 percent LYCRA™ (Spandex) and it is formed in a spandex type weave to exhibit a weight of about 3.5 ounces per square yard. The material has stretch ability in all directions and a close but not totally opaque weave. That is, there is sufficient pass-through space in the weave to permit free air circulation, yet prevent the passage of insects, even minute insects such as the common chigger.

The bottom part 14 is formed from the same material to include form-fitting right and left legs 28 and 30 which terminate with respective knit ankle cuffs 32 and 34. The top part of bottom part 14 terminates in a waist cuff 36 (as will be described in FIG. 2) which is tightly retained beneath outer waist cuff 26 for security purposes. The bottom part 14 also includes a front fly 38 which is suitably closed by means of either a zipper or a VELCRO® pile/hooks fabric combination, a hook and loop fastener. A snap-on hook device (not shown) can be fastened at the point of waist cuff joinder on the front fly 38. Conventional pant leg seaming may be employed and bottom part 14 can be formed with a diamond panel crotch inset to minimize the possibility of crotch seam splitting.

Figure 1B:
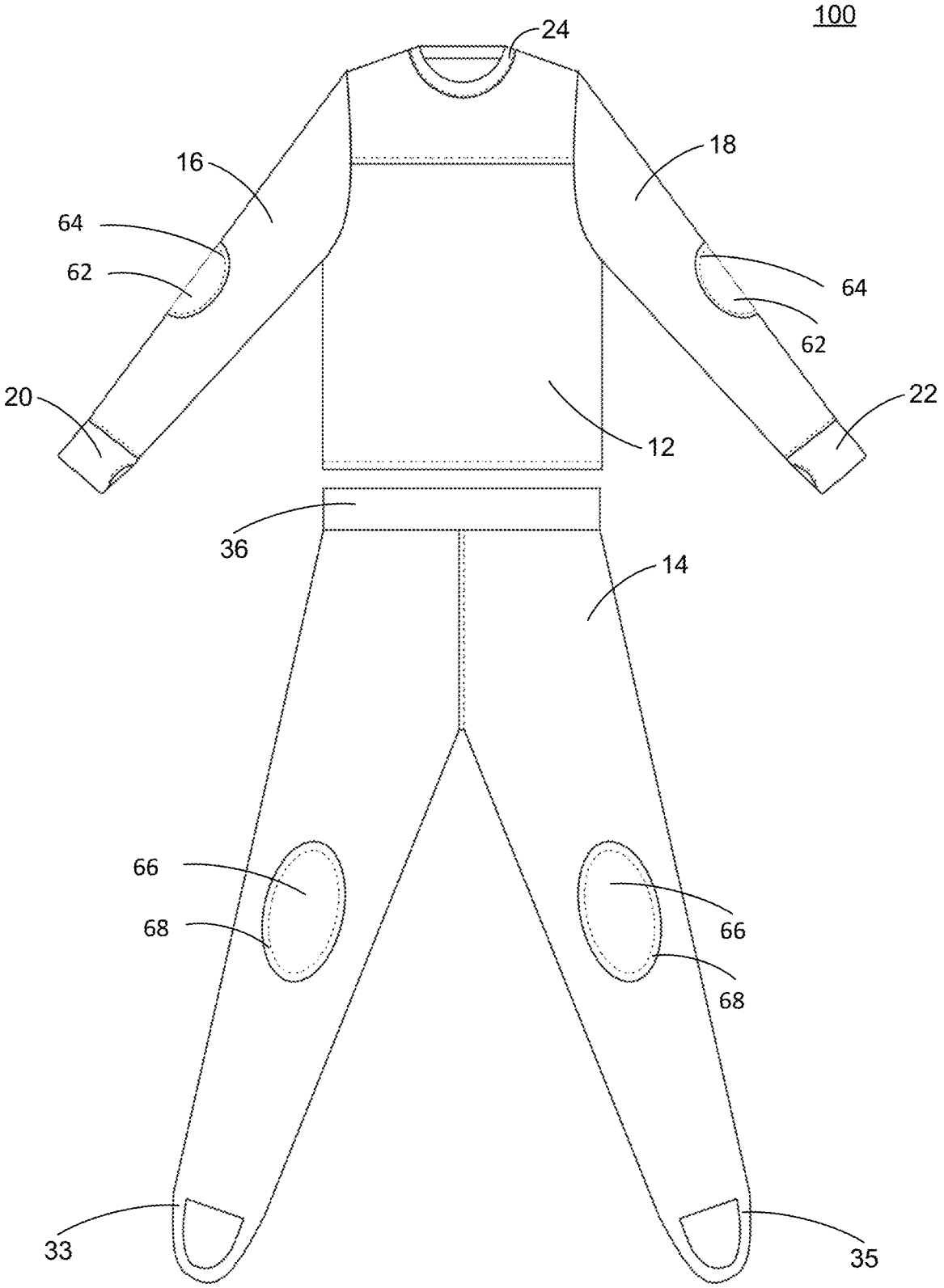

FIG. 1B shows another possible embodiment of an undergarment. An undergarment 10 includes an upper (shirt) part 12 and a bottom (pants) part 14 as described in FIG. 1A. The shirt part 12 includes right and left arms 16 and 18 which can terminate in respective knit cuffs 20 and 22, which can be elongated to cover part of the hands and may include optional thumbholes. The shirt part 12 can also include a knit collar 24. The bottom part 14 is formed from the same material to include form-fitting right and left legs 28 and 30 which terminate with respective ankle stirrups 33 and 35, which can be worn over the user's feet to minimize exposure of the ankle to insects and the environment. Said ankle stirrups 33 and 35 can be worn under socks or tucked into footwear. The top part of bottom part 14 terminates in a waist cuff 36. Areas of reinforcement (as described in FIGS. 5A-D) such as reinforcing elbow ply 62, stitching 64, reinforcement panels 66, and stitching 68 may be included. Additional areas of reinforcement, such as belly or chest panels (not shown) may also be included.

Figure 2:
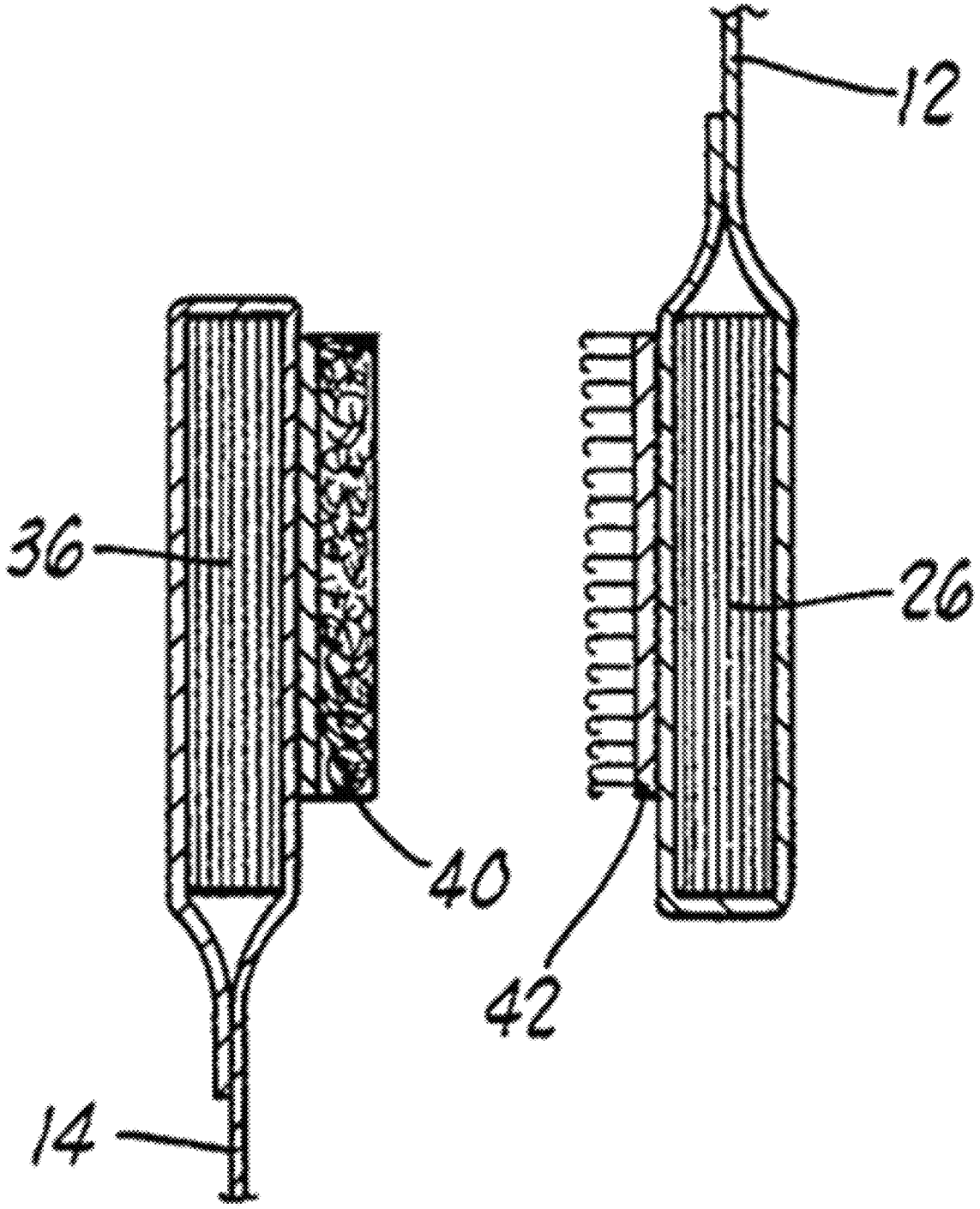
FIG. 2 is a section view of a waist band for top and bottom of an exemplary undergarment showing an exemplary means of joinder.

FIG. 2 shows one form of fabric combination for securing the top and bottom parts 12 and 14. The outer waist cuff 36 of bottom part 14 may include a VELCRO® hook and loop fastener or pile strip 40 sewn completely around the inside of waist cuff 36. In like manner, a VELCRO® hook strip 42 is sewn completely around the outer side of knit cuff 26 of the upper part 12. When the upper and bottom parts 12 and 14 are donned by the wearer, s/he can then place the outer knit waist cuff 26 in super-position over lower waist cuff 36 so that the pile strip 40 and hook strip 42 meshes around the circumference thereby to effect an insect-tight joinder of the top and bottom undergarment pieces.

Figure 3:
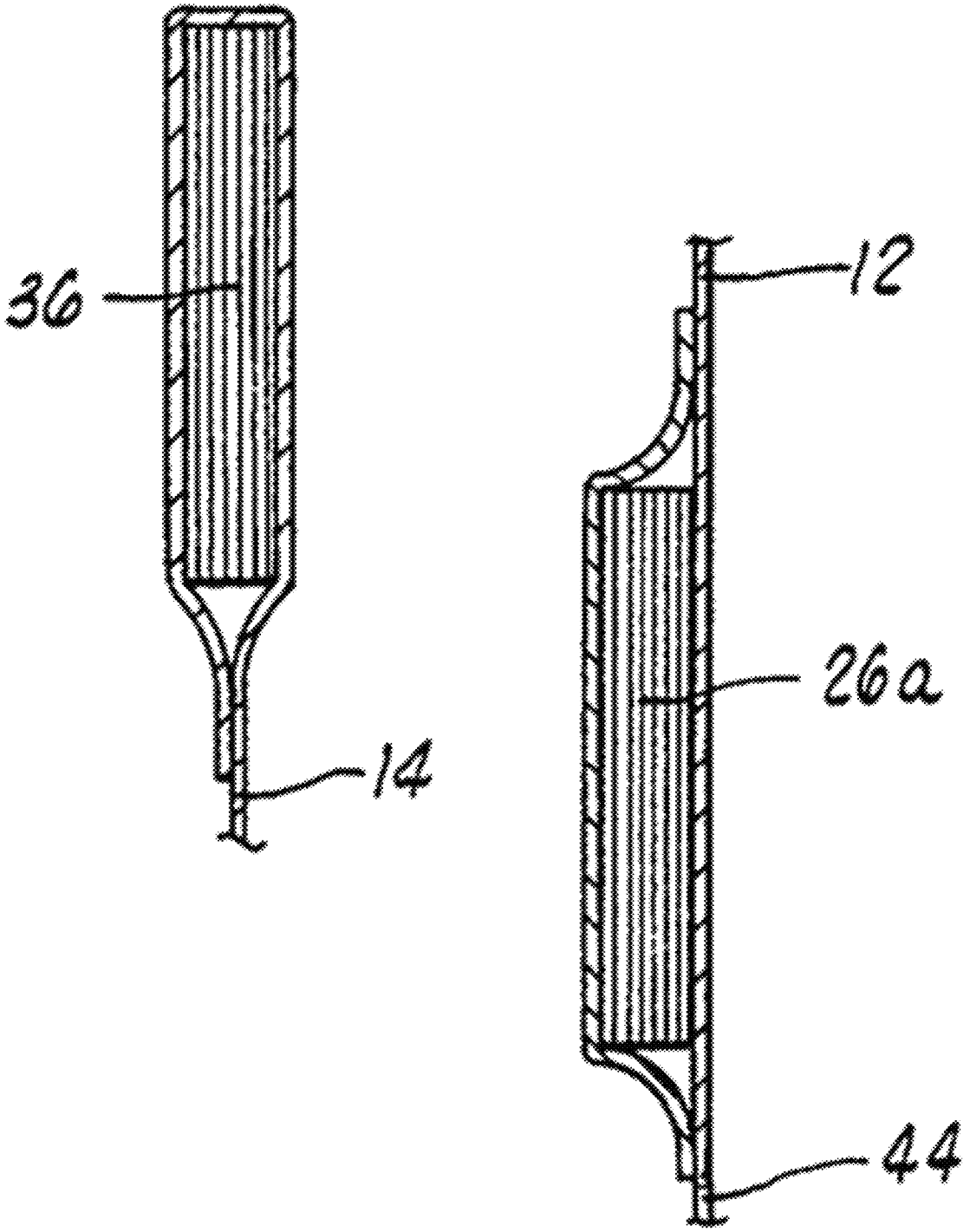
FIG. 3 is a section view of a waist band for top and bottom of an exemplary undergarment showing an exemplary means of joinder.

Alternative securing structure for joining the top part 12 to bottom part 14 is shown in FIG. 3. Thus, the top part 12 may include a slightly lower waist cuff 26*a* which, when tucked in, provides an interlocking relationship to the waist cuff 36. In addition, the top part 12 is formed to extend additional shirttail material 44 beneath waist cuff 26*a* to assure further that no break occurs between top part 12 and bottom part 14 during extended activity.

Figure 4:
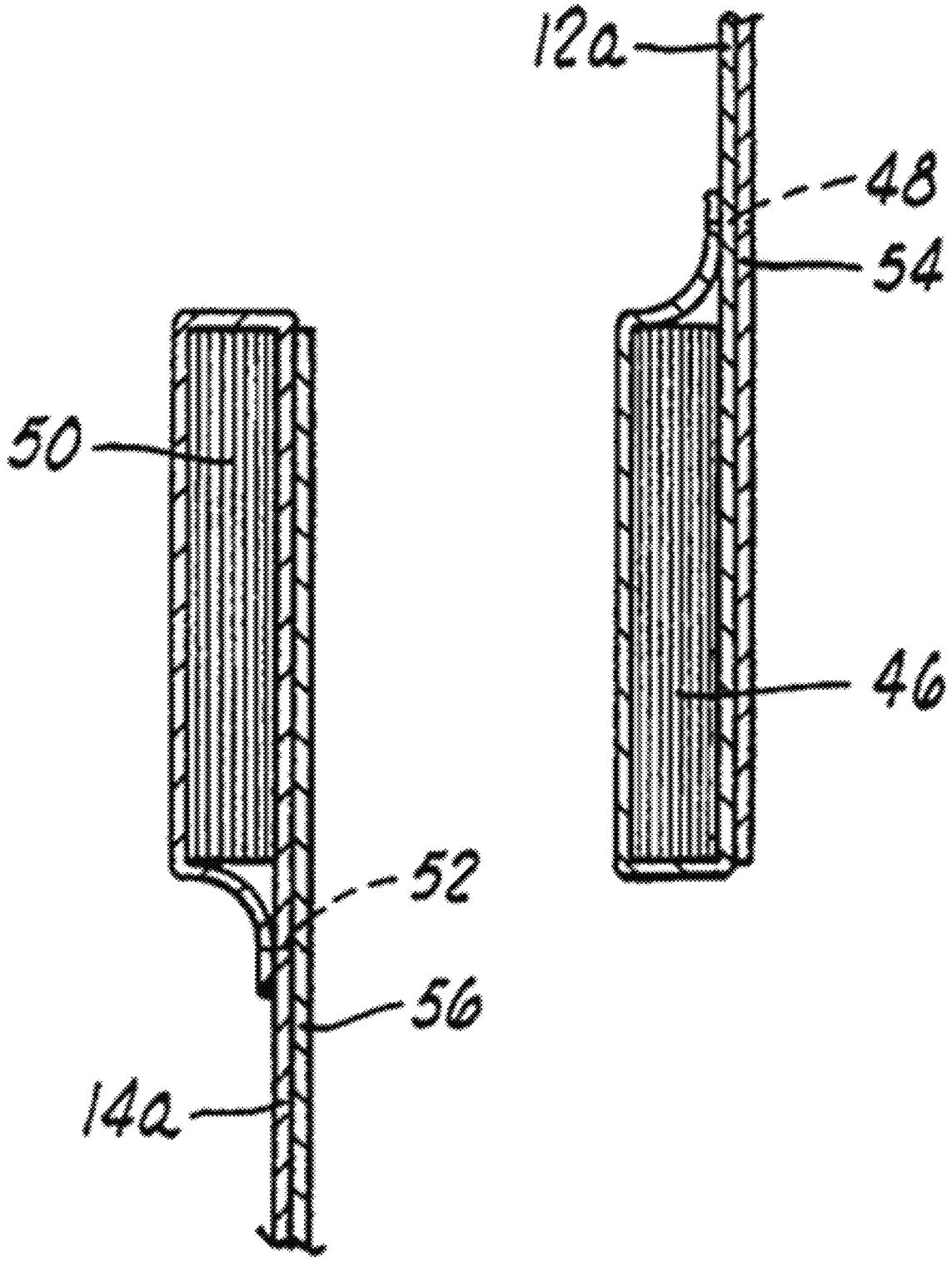
FIG. 4 is a section view of a selected portion for top and bottom members of an exemplary undergarment including a cotton liner feature.

FIG. 4 shows an alternative form of construction wherein the material of the upper part 12*a* and lower part 14*a* are simply stitched around their respective waist bands. That is, the upper part 12*a* material is folded totally around the waist cuff or elastic member 46 and secured by stitching 48. In like manner, the material of lower part 14*a* is folded around the waist cuff elastic member 50 and secured by stitching 52. Other security provisions such as those shown in FIGS. 2 and 3 may also be included in order to maintain integrity of insect-proof coverage.

FIG. 4 also shows the inclusion, in both bottom and top parts 12*a* and 14*a*, of a thin cotton material liner 54 and 56, respectively. The upper cotton liner 54 and lower cotton liner 56 may be extended throughout the entire torso, leg and body portions for the purpose of providing greater comfort in certain conditions. The lining using very light cotton fabric could add considerable heat insulation quality while further assuring insect protection, and it would be particularly desirable in cooler weather.

Figure 5A:
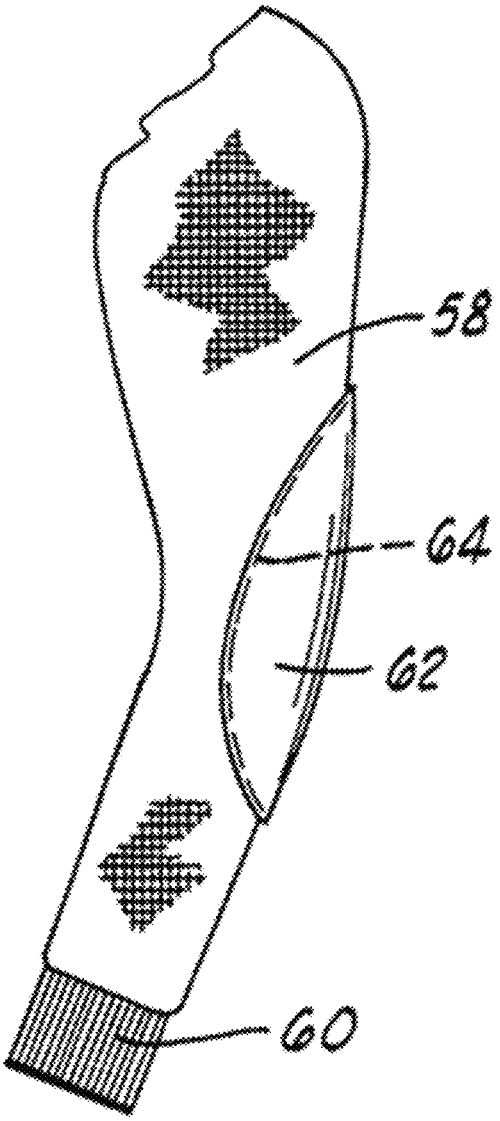
FIGS. 5A-5D are sectional views of an exemplary top (FIGS. 5A, 5C) and exemplary bottom (FIGS. 5B, 5D) demonstrating embodiments including reinforcement applied to the elbow and knee respectively.
Figure 5B:
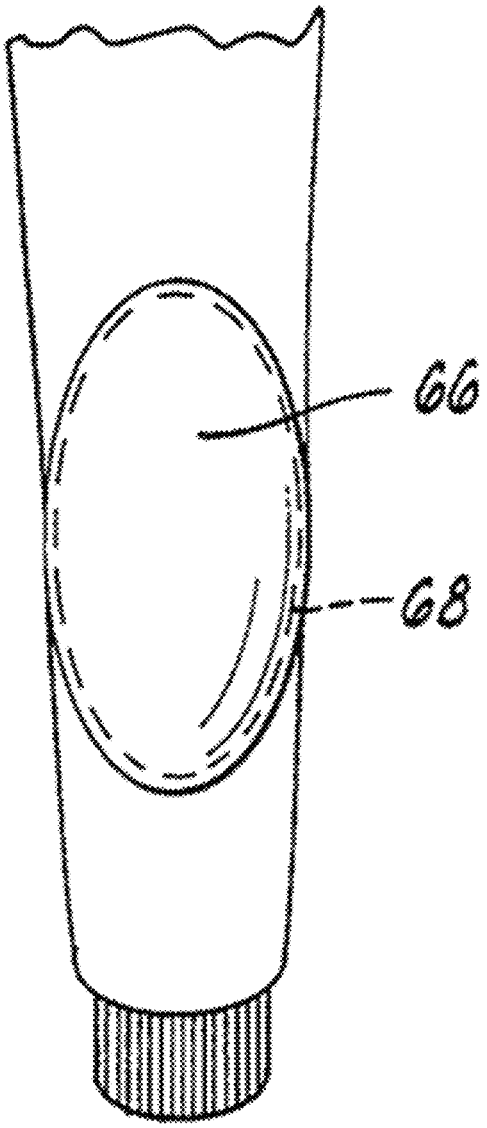
Figure 5C:
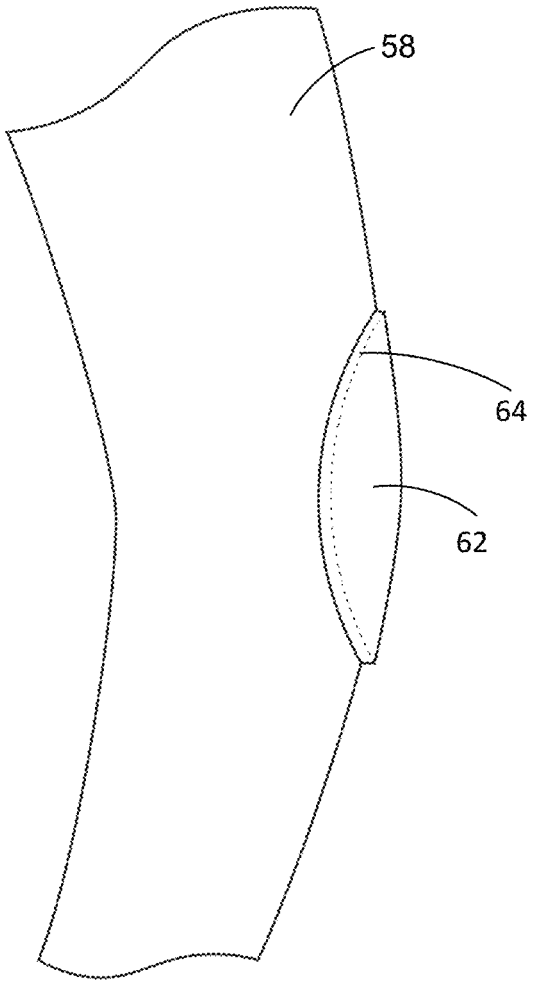
Figure 5D:
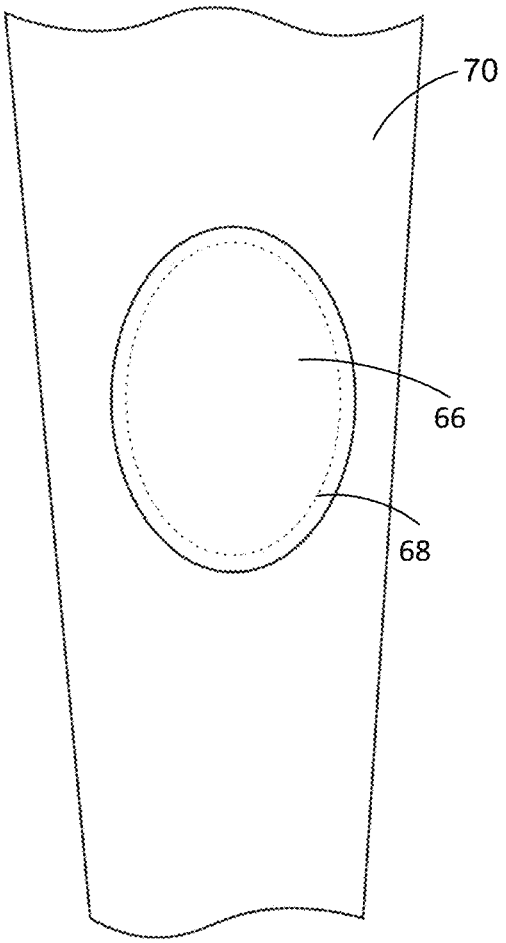
Figure 6A:
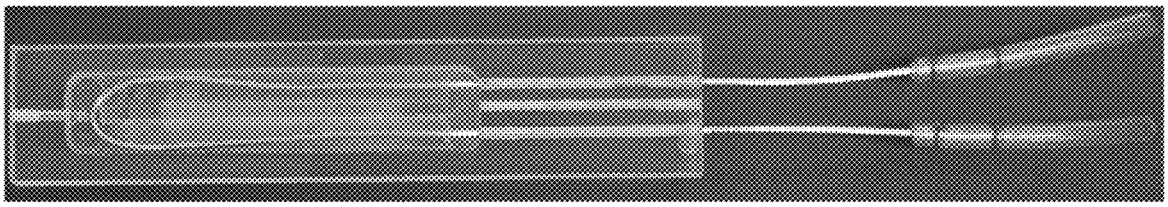
FIGS. 6A-6I show components of in vitro blood feeding device.
Figure 6B:
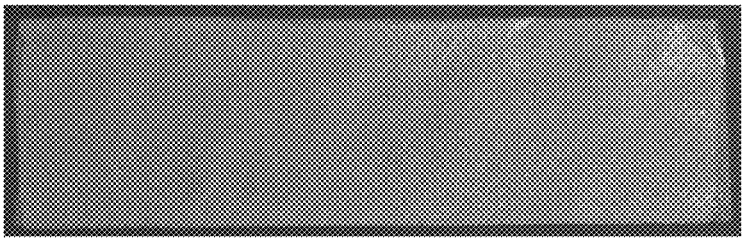
Figure 6C:
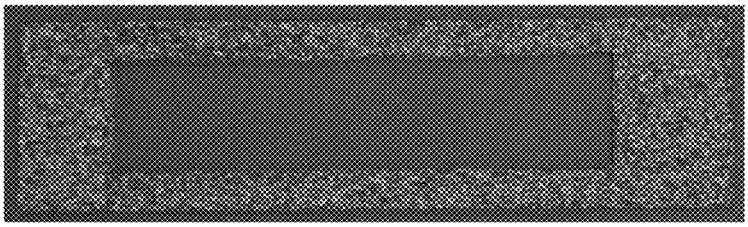
Figure 6D:
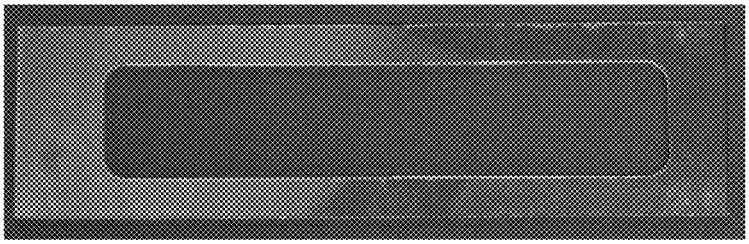
Figure 6E:
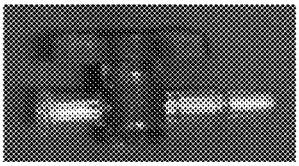
Figure 6F:
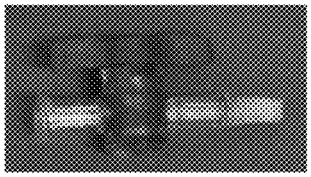
Figure 6G:
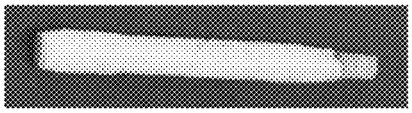
Figure 6H:
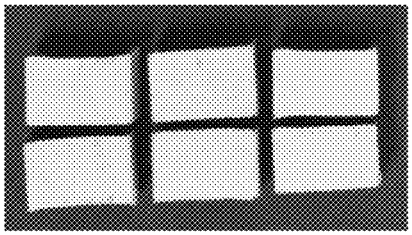
Figure 6I:
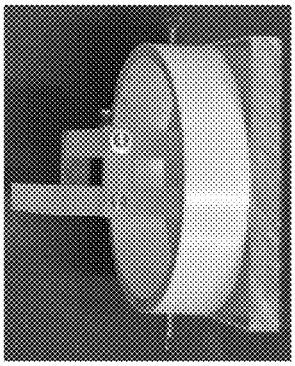
Figure 7A:
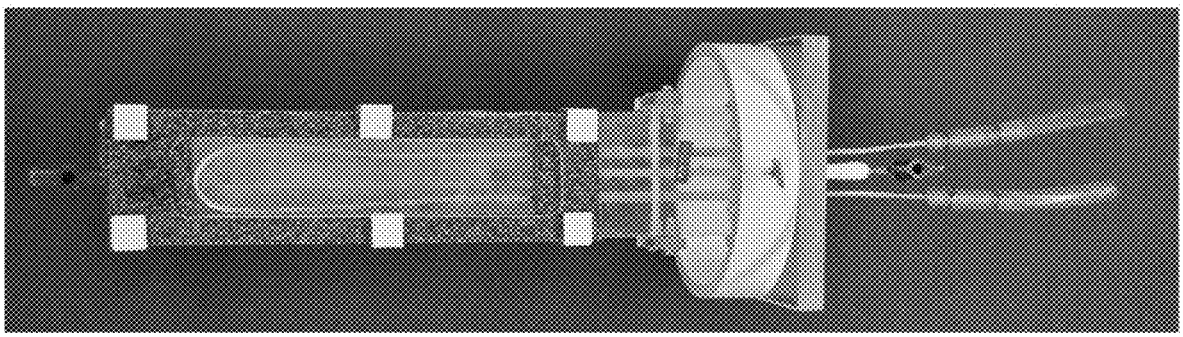
FIGS. 7A-7B show blood-feeding device with components assembled (FIG. 7A) and inserted into a bioassay cage (FIG. 7B).
Figure 7B:
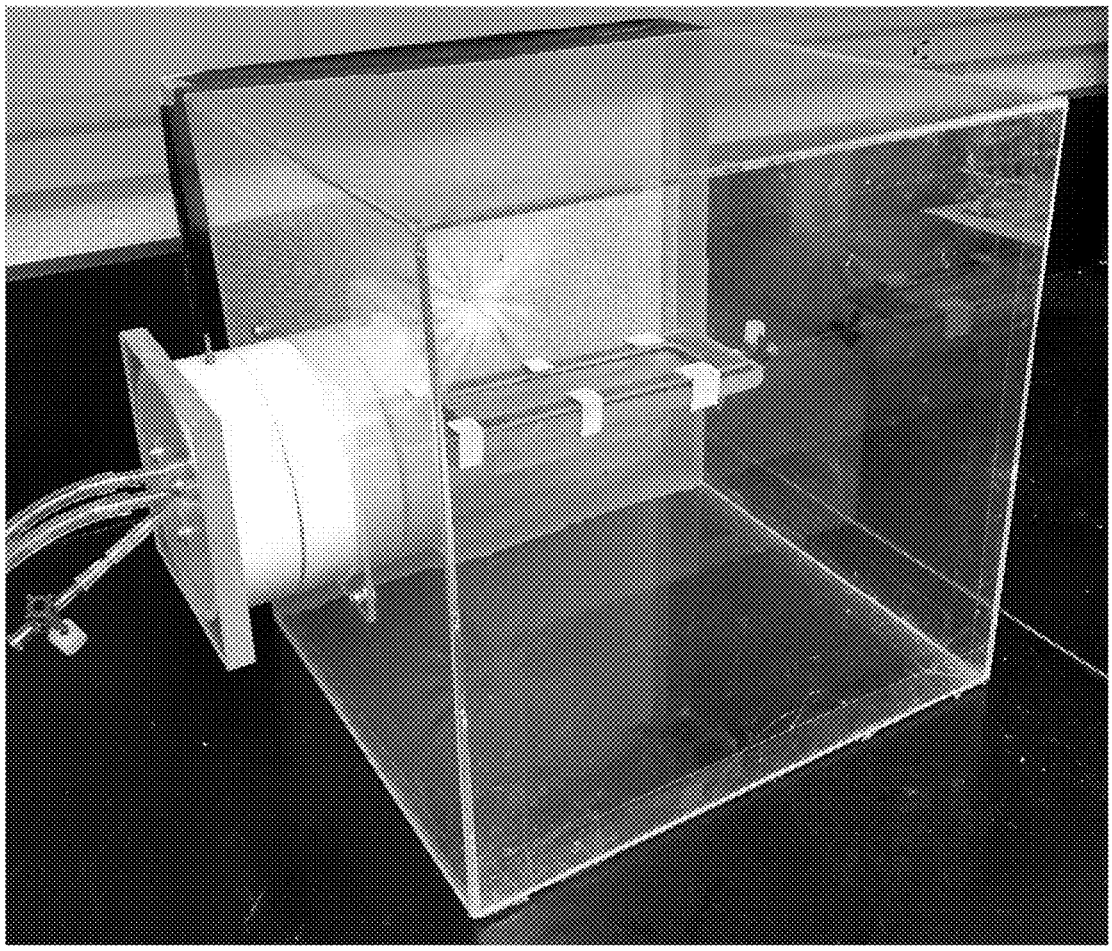

FIGS. 5A-5D illustrate a method of reinforcement which also may be included. Thus, FIG. 5A shows an arm 58 with cuff 60 and also includes a reinforcing elbow ply 62 of material which is secured by stitching 64. More than one ply 62 may be included in the reinforcement panel if desired. As shown in FIGS. 5B and 5D, similar reinforcement panels 66 and stitching 68 may be included in the lower parts of the undergarment on leg part 70 for knee protection. As shown in FIG. 1B, reinforcing elbow ply 62, stitching 64, reinforcement panels 66, and stitching 68 may be included in various embodiments.

The foregoing discloses a form of undergarment that provides protection against discomforts that one may encounter during outdoor, field activity. The undergarment is a form-fitting, coverall that is constructed from very lightweight, elastic material, and it functions quite favorably for outdoor activities of such as the military, hunters, fishermen and other outdoor disposed activities.

It should be emphasized that the above-described embodiments of the present disclosure are merely possible examples of implementations, and are set forth only for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

We claim:

1. A form-fitting insect-proof, protective undergarment, comprising:

an upper body form-fitting garment having a torso section and arm sections and being formed from a synthetic knit material of (i) 80 percent polyamide of 20 denier count and (ii) 20 percent elastane of 15 denier count, weighing about 2.8 ounces per square yard, and having 240% stretch in width and 160% stretch in length and having a jersey plated knit structure of 84 wales and 112 courses per inch with a pore size between 27 and 34 μm allowing air passage but preventing insect biting and passage;

an elastic neck cuff secured to define a neck opening of the torso section;

an elastic waist cuff secured to define a waist band around the torso section;

a pair of elastic wrist cuffs disposed at an outer terminus of each of the arm sections;

a lower body, form-fitting garment having a waist section and left and right leg sections and being formed from said synthetic knit material of 80 percent polyamide of 20 denier count and 20 percent elastane of 15 denier count weighing about 2.8 ounces per square yard and having 240% stretch in the width and 160% stretch in the length and having an jersey plated knit structure using 84 wales and 112 courses per inch with a pore size between 27 and 34 μm allowing air passage but preventing insect biting and passage;

an elastic waist cuff secured to define the waist band around the waist section; and a pair of elastic ankle cuffs disposed at the terminus of each of the left and right leg sections.

2. The undergarment according to claim 1, further comprising a fastener means for securing the elastic waist cuff of the upper body form-fitting garment to the elastic waist cuff of the lower body form-fitting garment, wherein the fastener means is a hook and loop fastener comprising:

a first strip of hook fastener secured around an outer surface of the waist band around the torso section; and a second strip of loop fastener secured around an outer surface of the waist band around the waist section; whereby the first and second strips may be joined together.

3. The undergarment according to claim 1, further comprising a light weight cotton material completely lining each of the upper body and lower body garments.

4. The undergarment according to claim 1, further comprising reinforcing material added by stitching to an elbow section of the upper body garment arm sections and the lower body garment leg sections.

5. A form-fitting insect-proof, protective undergarment comprising:

(a) an upper body form-fitting portion having:

a torso section having an elastic neck cuff secured to define a neck opening of the torso section;

a left arm section and a right arm section, each of the arm sections having an inner terminus attached to the torso section and an outer terminus having an elastic wrist cuff; and (b) a lower body, form-fitting portion having:

a waist section; and a left leg section and a right leg section, each of the leg sections having an inner terminus attached to the waist section and an outer terminus having an elastic ankle cuff;

wherein one or both of the upper body form-fitting portion and the lower body, form-fitting portion comprise a synthetic knit material comprising:

(i) about 70% to 90% by weight of a polyamide fiber based upon a total weight of the synthetic knit material, wherein the polyamide fiber has a fiber thickness of about 15 to 25 denier count;

(ii) about 10% to 30% of an elastane fiber based upon the total weight of the synthetic knit material, wherein the elastane fiber has a fiber thickness of about 10 to 20 denier count; and wherein the synthetic knit material has a weight of about 2.5 to 3.0 ounces per square yard, a stretch in a width of the synthetic knit material of about 200% to 260%, a stretch in a length of about 130% to 190%, a jersey plated knit structure having of about 80-90 wales and about 110-120 courses per inch, and an average pore size of about 27 μm to 34 μm.

6. The form-fitting insect-proof, protective undergarment according to claim 5, wherein the upper body and lower body form-fitting portions form a single garment.

7. The form-fitting insect-proof, protective undergarment according to claim 5, wherein the upper body and lower body form-fitting portions form separate garments, further comprising:

an elastic waist cuff of the upper body form-fitting portion to define the waist band around the torso section; and an elastic waist cuff of the lower body form-fitting portion to define the waist band around the waist section.

8. The form-fitting insect-proof, protective undergarment according to claim 5, further comprising a light weight cotton material completely lining one or both of the upper body and lower body garments.

9. The form-fitting insect-proof, protective undergarment according to claim 5, further comprising a reinforcing material added to an elbow on each of the left arm section and the right arm section.

10. The form-fitting insect-proof, protective undergarment according to claim 5, further comprising a reinforcing material added to a knee on each of the left leg section and the right leg section.

11. The form-fitting insect-proof, protective undergarment according to claim 5, wherein the synthetic knit material comprises about 80% of the polyamide fiber by weight based upon the total weight of the synthetic knit material.

12. The form-fitting insect-proof, protective undergarment according to claim 5, wherein the synthetic knit material comprises about 20% of the elastane fiber by weight upon the total weight of the synthetic knit material.

13. The form-fitting insect-proof, protective undergarment according to claim 5, wherein the polyamide fiber has a fiber thickness of about 20 denier count.

14. The form-fitting insect-proof, protective undergarment according to claim 5, wherein the elastane fiber has a fiber thickness of about 15 denier count.

15. The form-fitting insect-proof, protective undergarment according claim 5, wherein the synthetic knit material has a weight of about 2.8 ounces per square yard.

16. The form-fitting insect-proof, protective undergarment according to claim 5, wherein the synthetic knit material has a jersey plated knit structure having about 84 wales and about 112 courses per inch.

17. The form-fitting insect-proof, protective undergarment according to claim 5, wherein the synthetic knit material has a mosquito bite resistance of about 99% or more when measured according to an in vitro feeding bioassay described herein.

18. The form-fitting insect-proof, protective undergarment according to claim 5, wherein the undergarment has a mosquito bite resistance of about 99% or more when measured according to a Mosquito Arm-in-cage Bite test.

19. The form-fitting insect-proof, protective undergarment according to claim 5, wherein the lower body, form-fitting portion further comprises a fly flap disposed vertically in the waist section with a fastener means aligned therealong to effect closure of the fly flap.

* * * * *